US009181673B2

(12) United States Patent
Siepi

(10) Patent No.: US 9,181,673 B2
(45) Date of Patent: Nov. 10, 2015

(54) TOOLS AND METHODS FOR CONSTRUCTING LARGE DIAMETER UNDERGROUND PILES

(71) Applicant: TREVI S.p.A., Cesena (Forli Cesena) (IT)

(72) Inventor: Maurizio Siepi, Cesena (IT)

(73) Assignee: TREVI S.p.A., Cesena, Forli-Cesena (IT)

( * ) Notice: Subject to any disclaimer, the term of this patent is extended or adjusted under 35 U.S.C. 154(b) by 426 days.

(21) Appl. No.: 13/649,169

(22) Filed: Oct. 11, 2012

(65) Prior Publication Data

US 2013/0195560 A1 Aug. 1, 2013

(30) Foreign Application Priority Data

Oct. 13, 2011 (IT) ..... TO2011A0913

(51) Int. Cl.

| | |
|---|---|
| ***E02D 13/04*** | (2006.01) |
| ***E02D 7/00*** | (2006.01) |
| ***E21B 25/10*** | (2006.01) |
| ***E02D 5/34*** | (2006.01) |
| ***E02D 5/22*** | (2006.01) |
| ***E02D 27/12*** | (2006.01) |

(52) U.S. Cl.
CPC .. *E02D 5/34* (2013.01); *E02D 5/22* (2013.01); *E02D 27/12* (2013.01)

(58) Field of Classification Search
CPC ..... E02D 5/22; E02D 5/34; E02D 27/12
USPC ..... 405/232, 245, 249; 175/249, 257–259, 175/320, 325.1, 386, 408, 412; 166/55.1
See application file for complete search history.

(56) References Cited

U.S. PATENT DOCUMENTS

| | | | | |
|---|---|---|---|---|
| 4,900,198 | A * | 2/1990 | Hoaki | 405/303 |
| 4,915,543 | A * | 4/1990 | Akesaka | 405/156 |
| 5,002,432 | A * | 3/1991 | Dysarz | 405/195.1 |
| 6,729,416 | B2 * | 5/2004 | Contreras et al. | 175/20 |
| 7,021,404 | B2 * | 4/2006 | Fanuel et al. | 175/61 |
| 2010/0108392 | A1 | 5/2010 | Ressi di Cervia | |
| 2010/0270085 | A1 | 10/2010 | Turner | |

FOREIGN PATENT DOCUMENTS

WO 2009090034 A2 7/2009

* cited by examiner

*Primary Examiner* — Benjamin Fiorello
*Assistant Examiner* — Stacy Warren
(74) *Attorney, Agent, or Firm* — Robert E. Alderson, Jr.

(57) ABSTRACT

Methods are provided for the creation of large diameter piles in all types of soils (cohesive, cohesionless or rocky), particularly for the construction of bulkheads made of juxtaposed or secant piles, while maintaining the deviation from the vertical well below the limit ≤2% required by European standard EN 1536. The invention reduces verticality errors, advantageously exploiting the accuracy provided by the directional drilling technology. Tools for implementing such methods are also provided.

16 Claims, 4 Drawing Sheets

Fig.8
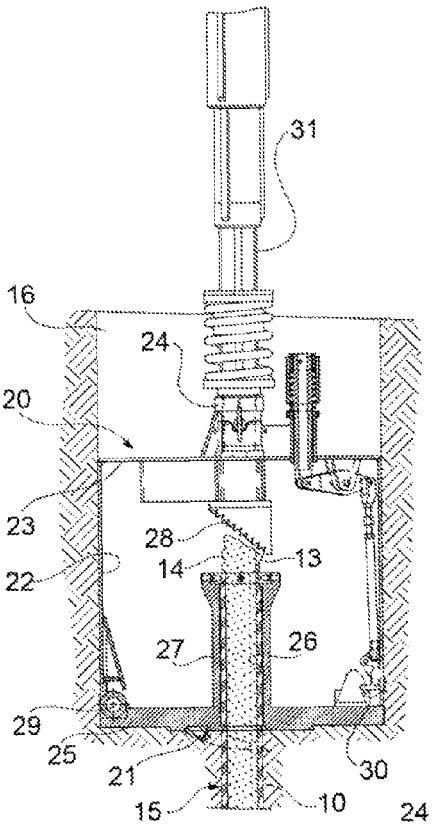
Fig.9
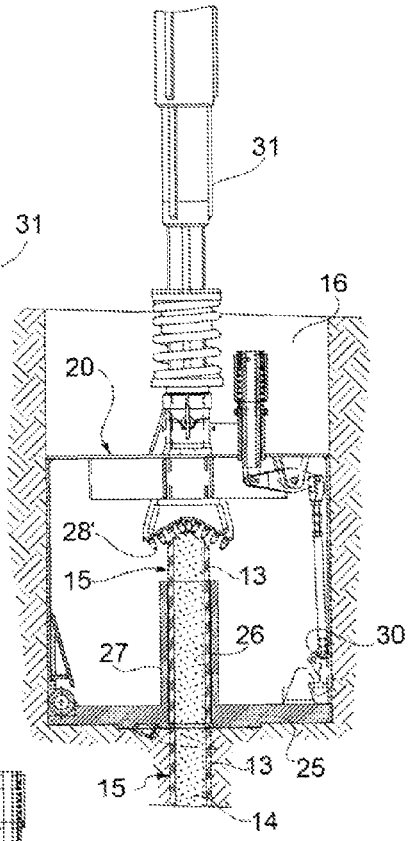
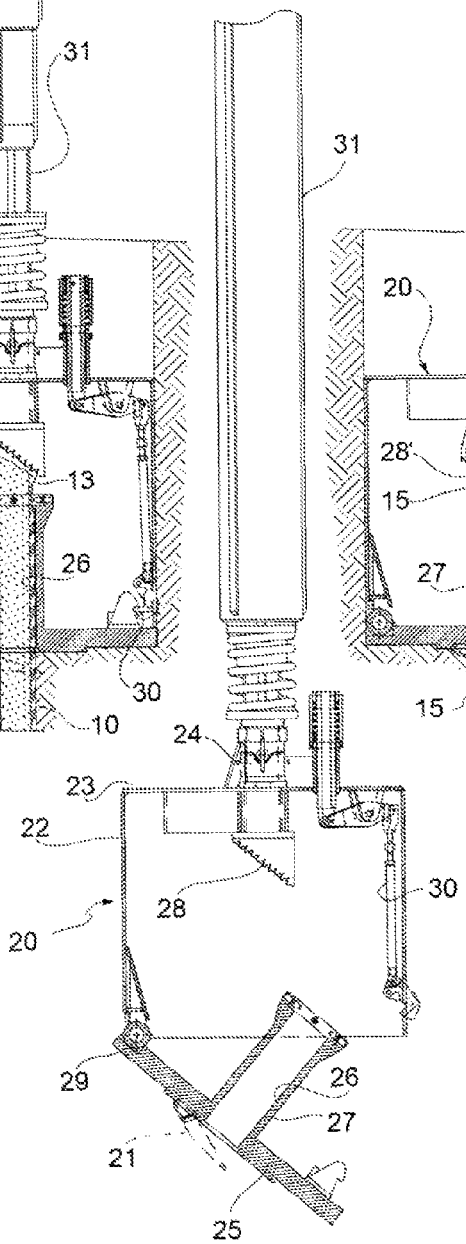
Fig.10

Fig.11
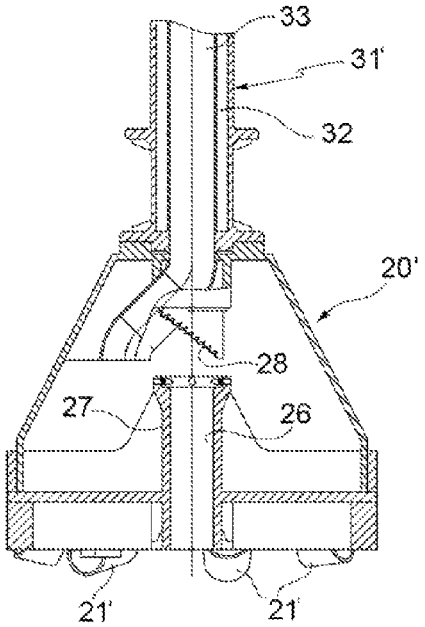
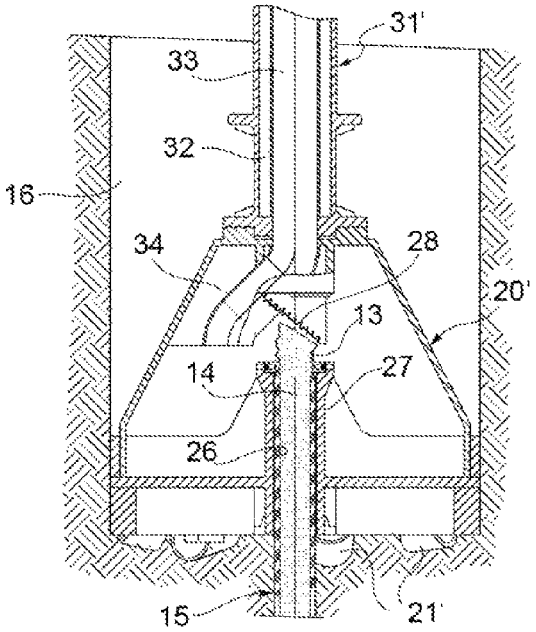
Fig.12

Fig.13
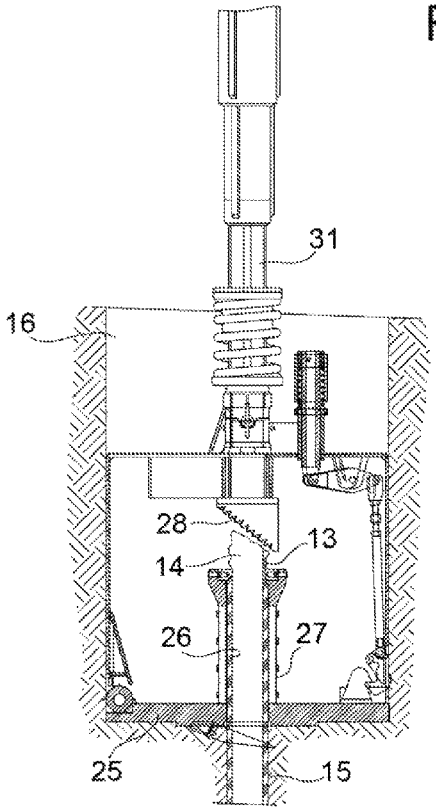
Fig.14
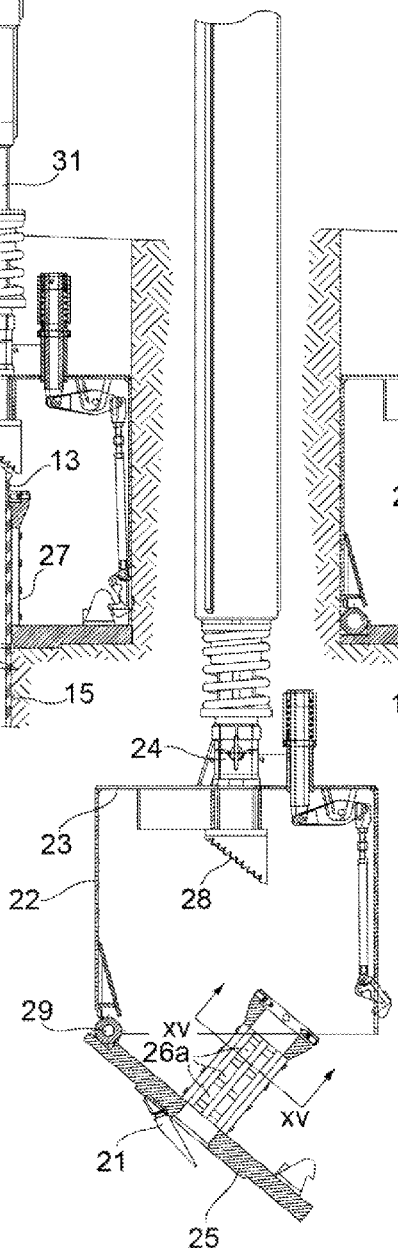
Fig.16
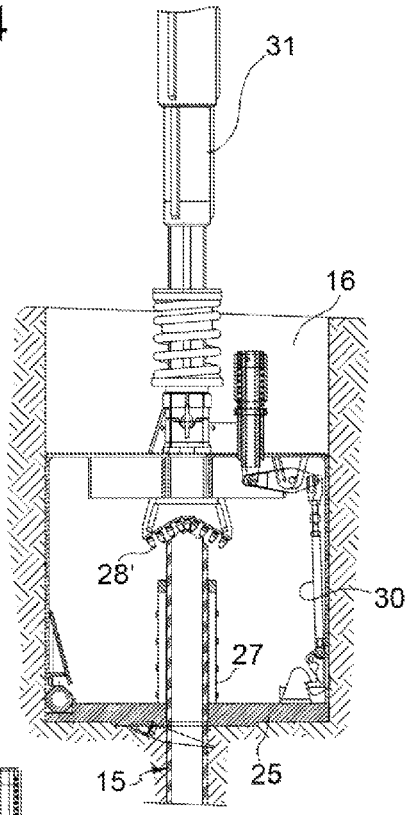
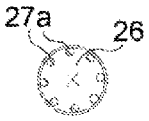
Fig.15

TOOLS AND METHODS FOR CONSTRUCTING LARGE DIAMETER UNDERGROUND PILES

CROSS REFERENCE TO RELATED APPLICATION

This application claims priority to and benefit of Italian Patent Application No. TO2011A000913 filed Oct. 13, 2011, the contents of which are incorporated by reference in their entirety.

FIELD OF THE INVENTION

The present invention relates to methods for constructing large diameter under-ground piles in all soils (e.g. cohesive, cohesionless, or rocky) with a small deviation error. The invention further relates to drilling tools for implementing such methods.

BACKGROUND OF THE INVENTION

When drilling in rock or concrete, the problem of performing pilot perforations is normally solved by using a drilling tool on which there is fixed a bit that follows a guiding borehole or pilot borehole. This method, however, cannot be implemented with cohesionless soil. In fact, if the excavation requires a reiteration of ascents and descents of the tool, there is a risk that the guiding borehole may become obstructed due to partial or total collapse of the walls of the borehole, or by the fall of debris not collected by the tool. In this case, the pilot borehole becomes filled with loose material, potentially causing the tip of the tool to exit from the guiding borehole. In addition, in soft soils, the soil surrounding the guiding borehole may not effectively counter lateral forces tending to move the tool from its defined trajectory.

US 2010/0108392 A1 describes a method for the construction of large vertical boreholes and underground cut-off walls made of piles. A drilling rig with double rotary heads drives a small diameter (between 50 mm and 400 mm) drill string, and a much larger diameter drill string, which is concentric with the smaller drill string and has an annular drill bit at a lower end thereof. A steerable "mud motor" drill is provided on a lower end of the smaller drill string to make a borehole as vertical as possible. The outer drill string is advanced, enlarging the borehole and using the inner drill string as a verticality guide. This method is known for small diameter drillings. In the case of larger diameters, however, problems arise due to the great sizes and weights, which make the procedure much more difficult to implement. Such methods, therefore, require considerable modifications of commercially available machines which are commonly used for making large diameter piles.

The construction of large diameter piles typically involves the use of a bucket rigidly connected to a telescopic rod (Kelly bar) that drives and rotates the bucket. The excavation is performed by means of the reiteration of an excavation step, during which the bucket is lowered into the hole and digs by filling with the excavated soil, and a step of emptying the bucket, during which the bucket is extracted from the borehole and emptied. The two steps are repeated until the prescribed depth of the borehole is reached.

Due to the clearance between the parts of the bucket-Kelly bar system, drilling of piles typically leads to deviations from the vertical up to 2%. This limit is set in European Standard EN 1536. For those cases where the piles are meant to withstand vertical loads, this deviation does not involve particular problems. However, in case the piles are used to create a waterproof underground cut-off wall or bulkhead, or where the piles must be set side to side, this limit can create significant problems, giving rise to defects in the overall geometry of the underground wall.

SUMMARY OF THE INVENTION

The present invention allows for the creation of large diameter piles in all types of soils (cohesive, cohesionless or rocky), particularly for the construction of bulkheads made of juxtaposed or secant piles, while maintaining the deviation from the vertical well below the limit ≤2% required by European standard EN 1536. The invention reduces verticality errors, advantageously exploiting the accuracy provided by the directional drilling technology.

In a first step according to methods of the present invention, a directional drilling is performed using conventional techniques. A relatively narrow borehole is so-formed. A tube of mechanically erodible material is inserted in the borehole. The tube may be filled with a hardening mixture to obtain a guide core which extends with precision in a direction coinciding with the central axis of the large diameter pile to be built. Subsequently, a widened borehole may be excavated around the core formed by the guide tube. In this excavation step, a drilling tool may be used which has a central, inner cylindrical cavity that is inserted and centered on the core so that the tool can rotate and slide in a guided manner on the same core. The drilling tool may be provided with soil cutter elements for digging the soil and, internally, with elements for breaking up the core progressively as the widening of the excavation proceeds.

A few preferred, but not limiting embodiments of methods and drilling tools in accordance with the invention will now be described, reference being made to the attached drawings briefly discussed below.

BRIEF DESCRIPTION OF THE FIGURES

FIGS. 8 and 9 are vertical cross-sectional views showing two embodiments of a drilling tool during excavation steps.

FIG. 10 shows a drilling tool of FIG. 8 extracted from the borehole while emptying the cuttings.

FIGS. 11 and 12 are vertical cross-sectional views of an embodiment of a reverse circulation drilling tool, shown in isolation and during an excavation step.

FIGS. 13 and 14 are vertical cross-sectional views of a further embodiment of a drilling tool, during an excavation step and during the emptying of the cuttings, respectively.

FIG. 15 is a cross-sectional view taken along line XV-XV of FIG. 14; and FIG. 16 is a vertical cross-sectional view of another embodiment of a drilling tool.

DETAILED DESCRIPTION

Figures 1, 2, 3, 4, 5, 6, 7:
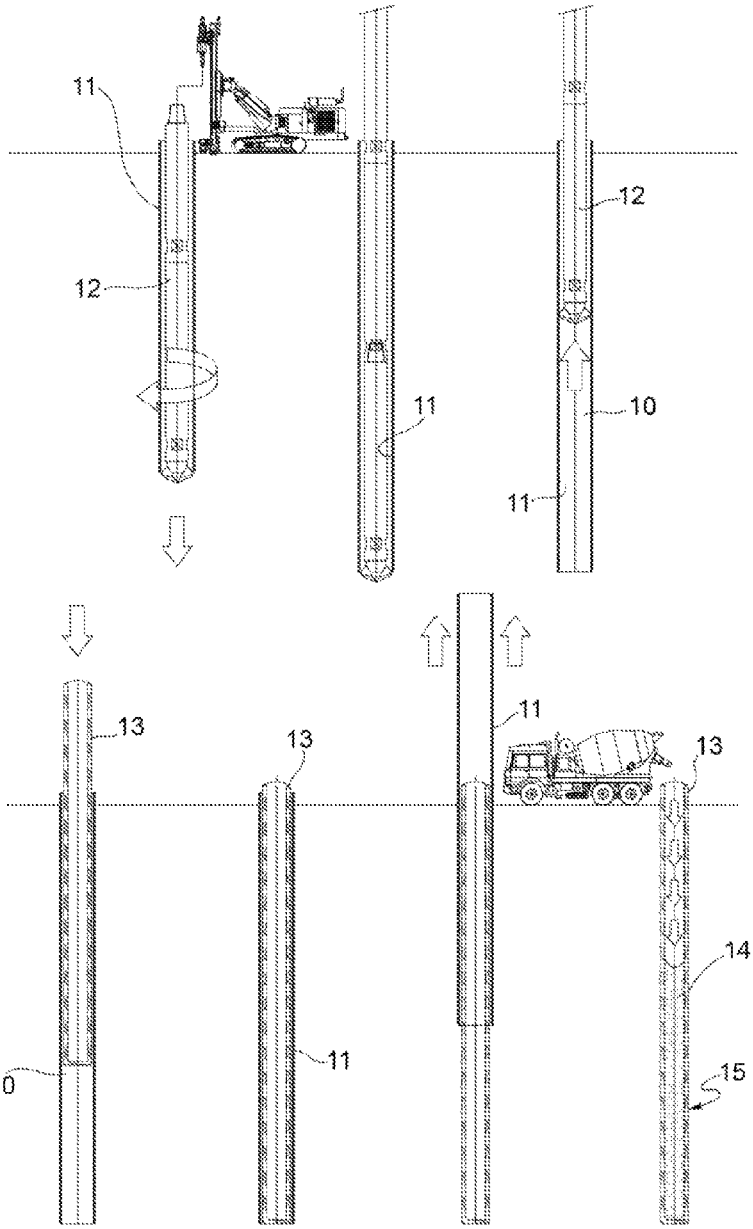
FIGS. 1 to 3 show excavation steps of a pilot borehole.
FIGS. 4-6 show the insertion of a tube of mechanically erodible material in the pilot borehole.
FIG. 7 shows the casting of a hardening mixture into the tube inserted in the pilot borehole.

Referring initially to FIGS. 1 to 3, methods according to the present invention provide, as a preliminary step, performing a vertical directional drilling using conventional techniques (mud motor, directional drilling, etc.), so as to obtain a pilot borehole 10 of small diameter. As used herein, the expression "small diameter" should be construed as indicating diameters ranging approximately between 50 mm and 400 mm. The drilling may be performed using known directional (or "steerable") drilling systems, using tools and instruments to control the direction of the hole (e.g. asymmetric bits, singleshot or multi-shot instrumentation, measuring-while-drilling, etc.). The direction control, which can be performed continuously and in real-time or intermittently, allows for the correction of the direction of the borehole, when this is necessary. Methods and equipment used for directional drilling are well known in the art and need not be described in detail herein.

In instances where one has to operate, wholly or in part, in cohesionless or otherwise unstable kinds of soil, it is preferable to coat the perforation in order to sustain the walls of the pilot borehole by inserting in advance a coating casing 11. This operation may take place simultaneously or subsequently to the drilling, using known techniques, for example dual head drilling (e.g. with an upper rotary driving an inner rod 12 and a lower rotary driving the casing 11), or single head drilling with a drive (e.g. a single rotary moves the rod, and the casing is driven through a combined rotation and thrust imparted by a drive connected to the rotary head), or in overburden drilling by using downhole drilling heads that drive the casing 11 from below (with or without rotation), or, still differently, with appropriate vibrating heads that drive or roto-drive the casing.

Upon completion of the pilot borehole, and checking that it complies with verticality tolerances according to the design, a pilot tube 13 of strong but mechanically erodible material may be fitted into the pilot borehole. Suitable materials for the pilot tube include, for example, PVC, fiberglass or other plastic materials such that the pilot tube 13 may subsequently be destroyed, as explained below.

Furthermore, due to the fact that the outer diameter of the pilot tube 13 is smaller than the pilot borehole 10 and the inner diameter of the casing 11, the tube 13 may be arranged along an axis that is nearer to a vertical line than the axis of the pilot borehole.

If a casing 11 has been used for lining the pilot borehole, the mechanically erodible tube 13 may be inserted in the casing (FIGS. 4 and 5). Otherwise, the tube 13 may be inserted directly into the open pilot borehole that is obtained at the end of the drilling. Depending on the mechanical characteristics of the soil, the casing also may be inserted only partially into the borehole, in order to support the walls of the borehole only in the area having unstable soil. After fitting the tube of erodible material into the pilot hole, the casing (if provided) may be removed (FIG. 6).

Subsequently, the erodible tube 13 may be filled with a hardening mixture 14 (FIG. 7), for example a concrete mixture or a plastic mixture, with or without added fiber to increase its consistency. The erodible tube and the mixture, once hardened, together constitute a pilot core 15 which extends precisely along the axis on which the large diameter pile is to be constructed. The pilot core 15 allows for precise guidance of a drilling tool 20, shown in FIGS. 8 and 10. The drilling tool is driven by making it slide along and rotate around the core to enlarge the borehole by following a drilling movement. When using an erodible tube 13 which is, alone, sufficiently strong for the specific application, the subsequent step of filling it with a hardening mixture may be omitted, whereby in such a variant the pilot core may consist only of the erodible tube 13.

In further embodiments of methods according to the present invention, the cylindrical guiding pilot core 15 may be prefabricated and subsequently driven into the ground. Variants of this embodiment may include driving the core 15 in a pilot borehole excavated in advance (similar to the borehole 10), or driving the prefabricated core 15 directly in the ground, without excavating a preliminary pilot hole. The prefabricated core may be made by filling a tube of mechanically erodible material with a hardening mixture, as described above. As an alternative, the core may be prefabricated as a full cylindrical body composed of a single element or several elements, each made of mechanically erodible material, for example concrete (non-reinforced) elements, mechanically connected to one another.

In the embodiments shown in FIGS. 8 to 10, the drilling tool is a bucket-type drilling tool. The tool is provided with lower cutter elements 21, for example one or more rows of cutting teeth arranged in a radial direction, and a cylindrical or substantially cylindrical side wall 22 connecting the lower cutter elements 21 to a roof or upper base 23 of the bucket. The roof of the bucket has an upper attachment 24, generally of square cross-section, designed to be coupled for rotation with the lowermost section of a drilling rod 31, for example of the type known as "Kelly bar".

The lower cutter elements 21 may be fixed to a rigid bottom 25 having a through-opening (not shown) to allow the entry of cuttings into the bucket, and a central cylindrical cavity 26 which may be inserted coaxially on the core 15 so as to center the tool 20 and to guide the excavation to enlarge the hole around the pilot core. The cylindrical cavity 26 may be a through-cavity defined by a tubular portion 27, formed as a single piece or otherwise firmly and rigidly fixed to the bottom 25, projecting vertically inside the tool 20 and coaxially with respect to the cylindrical wall 22. The lower part of the central cylindrical cavity 26 may have a flared shape to facilitate the entry of the tube 13 each time the bucket is lowered into the borehole to deepen the excavation.

Inner cutter elements 28 (e.g. teeth, blades, or bits) are fixed inside the tool 20 and arranged above the cylindrical guiding cavity 26, preferably aligned axially therewith.

Through the attachment 24, the drilling tool 20 can perform a combined movement of rotation and advancement around and along the core 15.

The tool 20 may advance along the core and may form around this a widened borehole 16 through the operation of the lower cutter elements 21. At the same time, the inner cutter elements 28 may progressively destroy the pilot core 15, thereby allowing the drill to progress downward.

The drilling tool of the embodiments shown in FIGS. 8 to 10 may be used as a conventional bucket for the construction of bored piles, if necessary making use of sludge for sustaining the enlarged borehole 16, and alternating the drilling step and the step of withdrawing the bucket upwards and emptying it. In this example, the bucket may be fixed to a telescopic rod 31 of the type known as a Kelly bar. The bottom 25 of the bucket drilling tool 20 may be secured to the cylindrical wall 22 by a horizontal hinge 29. The bucket 20 may be provided with a release device 30 to release the bottom 25 so as to empty it of the cuttings when the bucket is extracted out of the borehole 16.

The shape, arrangement and number of inner cutter elements may vary. In the example of FIGS. 8 and 10, the inner cutter elements 28 are arranged in an oblique plane. In the example of FIG. 9, the inner cutter elements 28' are arranged according to a downwardly facing concave surface, for example a conical surface, so as to facilitate the centering and balancing of forces and reactions exchanged between the bucket and the core. In FIGS. 8 to 10, the inner cutter elements are fixed below the roof or upper base 23.

Alternatively, the step of drilling and widening the borehole around the central core may be performed using a reverse circulation, continuous drilling technique. According to this embodiment, shown in FIGS. 11 and 12, the drilling tool 20' may be fixed to the bottom of a string of rods 31' having a peripheral lateral passage 32 which communicates at the bottom with a central duct 33, which may be coaxial to the passage 32 or extend at a side thereof. Pressurized air may be injected through the peripheral passage 32, while the central duct 33 may be used to convey the excavated cuttings upwards. The borehole 16 (FIG. 12) may be filled with a fluid (e.g. water, or a polymer, or bentonite mud), while pressurized air is injected into the peripheral passage 32 through the rods. In the example of FIGS. 11 and 12, the lower cutter elements 21' are of the "roller bit" type. The excavated cuttings or debris enter into the tool through openings (not shown) formed in the bottom 25'.

The air pressure fed into the passage 32 generates a vacuum in the central duct 33, causing the mud to flow upwards together with the excavated debris through the central duct 33. A tubular element 34, connectable in use to the central duct 33, opens above the bottom 25 for the removal of debris collected in the drilling tool 20'.

In certain embodiments, the tool may comprise a central tubular portion 27 having a cylindrical, axial internal cavity 26. The cavity 26 may be inserted and centered on the core 15, which is cemented into the ground, so that the tool may rotate around the core 15 and be guided along the latter in performing the movement that excavates the borehole 16. The inner cutter elements 28 or 28' may be arranged in various ways, as mentioned for the embodiments shown in FIGS. 8 to 10, in order to destroy the core 15 as the drilling proceeds.

In other embodiments, the cylindrical cavity 26 may be open at the top. The inner cutter elements 28, 28' may be spaced above cylindrical cavity 26, so that the debris or cuttings of the eroded core 15 will fall inside the tool, above its bottom 25, 25', and thus be removed along with the excavated soil cuttings.

Once the borehole 16 has been enlarged for the desired length, or the entire length of the pilot core 15, a reinforcement may be fitted in the borehole. The borehole may than be filled with concrete, thus obtaining a large diameter pile.

FIGS. 13 to 16 show two further embodiments of a drilling tool having a cylindrical cavity 26 with a number of side openings 26*a* through which the cuttings of the guiding pilot core 15, being eroded, may fall directly onto the bottom 25 of the tool. In these embodiments, the central tubular portion 27 defining the axial cylindrical cavity 26 inside it may be formed by metal bars 27*a*, which may be welded in such a way as to form a cage-like structure defining the cavity 26 and the side openings 26*a* thereof.

As will be appreciated, the present method allows for the construction of large diameter piles having high accuracy even in cohesionless soils, using directional drilling technology.

It is understood that the invention is not limited to the embodiments described and illustrated herein, which are to be considered as examples for implementing the methods and the drilling tools. Various modifications as to the shape, size and arrangement of parts, as well as constructional and functional details and materials will be apparent to those skilled in the art in view of the foregoing.

The invention claimed is:

1. A method of constructing large diameter underground piles, comprising the steps of:

a) providing an underground, small diameter cylindrical pilot core made of mechanically erodible material extending along a central axis of a pile to be constructed;

b) excavating the soil around the pilot core using the pilot core as a guide for a drilling tool, the tool comprising:

a central, cylindrical guiding cavity adapted to fit around the core;

first lower cutter elements for drilling the soil underneath the tool; and second inner cutter elements located above the cylindrical guiding cavity, for milling the top of the core as the tool moves downward guided along the same core; and c) milling the top of the core as the tool moves downward guided along the core and filling the borehole formed by the soil excavation with concrete.

2. The method of claim 1, wherein said step a) comprises the steps of:

excavating a small diameter pilot borehole in the ground; and inserting a cylindrical pilot tube of a mechanically erodible material into the pilot borehole to form the core.

3. The method of claim 2, further comprising filling the pilot tube with a hardening mixture.

4. The method of claim 3, wherein the step of inserting the pilot tube is preceded by a step of driving a casing into the pilot borehole, and wherein the pilot tube is inserted into said casing.

5. The method of claim 4, wherein the step of filling the pilot tube with the hardening mixture is followed by a step of removing the casing from the pilot borehole.

6. The method of claim 3, wherein the hardening mixture which is cast in the pilot tube comprises a fiber reinforced cement mixture.

7. The method of claim 2, wherein the pilot borehole is drilled using steerable drilling techniques.

8. The method of claim 1, wherein step a) further comprises:

prefabricating the cylindrical pilot core, and driving the prefabricated pilot core into the ground along the central axis of the pile to be constructed.

9. The method of claim 8, wherein said driving step is preceded by a step of preliminarily drilling a small diameter pilot borehole in the ground, and that subsequently, during said driving step, the prefabricated pilot core is driven into the pilot borehole.

10. The method of claim 8, wherein the prefabricated pilot core is driven directly into the ground without drilling a preliminary pilot borehole.

11. The method of claim 8, wherein the step of prefabricating the pilot core comprises:

providing a cylindrical pilot tube of mechanically erodible material, and filling the pilot tube with a hardening mixture.

12. The method of claim 8, wherein the prefabricated pilot core comprises a full cylindrical body made of a single piece.

13. The method of claim 1, wherein the step of excavating the soil around the pilot core is performed using a reverse circulation drilling technique, which comprises:

flooding a widened borehole excavated by the tool with a fluid, and sending compressed air to the tool through a first conduit in a drill string rod having a second conduit through which the fluid is sent to a surface with cuttings made by the drilling tool.

14. A bucket type drilling tool comprising a first lower cutter element for drilling the soil underneath the tool;

a central cylindrical guiding cavity extending upward from an open bottom base under which the first lower cutter element is fixed;

a second inner cutter element arranged above the cylindrical guiding cavity for milling the top of a pilot core as the tool moves downward guided along the pilot core;

a roof with an upper connection providing mechanical connection to a drill string;

a substantially cylindrical side wall connecting the bottom base to the roof;

a tubular inner portion, arranged at least partially above the bottom base, the tubular inner portion extending coaxially within the side wall and forming the central cylindrical guiding cavity;

articulation units pivotally connecting the bottom base to the side wall; and releasable locking units for locking the bottom base to the side wall in an excavating arrangement, and for releasing the bottom base from the side wall so as to allow the bottom base to tilt around the articulation units and open to empty the bucket type drilling tool.

15. The drilling tool of claim 14, wherein the second inner cutter elements are arranged spaced above the cylindrical guiding cavity and wherein the cylindrical guiding cavity is open at the top.

16. The drilling tool of claim 14, wherein the cylindrical guiding cavity provides a plurality of side openings through which cuttings of the pilot core after being eroded are allowed to fall out onto the bottom base of the tool.

* * * * *